United States Patent [19]

Ballard

[11] 4,217,920

[45] Aug. 19, 1980

[54] CLEANING MACHINE WITH EXTERNALLY MOUNTED TURNTABLE TROLLEY OPERATOR

[76] Inventor: Thomas B. Ballard, 25550 Mulberry Dr., Southfield, Mich. 48075

[21] Appl. No.: 44,891

[22] Filed: Jun. 4, 1979

[51] Int. Cl.[2] ..... B08B 3/02

[52] U.S. Cl. ..... 134/141; 134/153; 134/164; 134/200

[58] Field of Search ..... 134/138–139, 134/141, 143, 153, 158, 164–165, 200

[56] References Cited

U.S. PATENT DOCUMENTS

| | | | |
|---|---|---|---|
| 2,633,399 | 3/1953 | Haas | 134/200 X |
| 2,643,662 | 6/1953 | Bunce | 134/164 |
| 2,724,392 | 11/1955 | Cooper | 134/141 X |
| 3,422,826 | 1/1969 | Ballard | 134/139 X |
| 3,452,763 | 7/1969 | Ballard | 134/139 X |
| 3,656,491 | 4/1972 | Ballard | 134/139 X |
| 3,724,636 | 4/1973 | Wright | 134/164 X |
| 3,759,276 | 9/1973 | Nolte | 134/164 X |
| 4,133,340 | 1/1979 | Ballard | 134/139 X |

*Primary Examiner*—Robert L. Bleutge
*Attorney, Agent, or Firm*—Krass & Young

[57] ABSTRACT

A cleaning machine of the type utilized for the cleaning and degreasing of parts, in which the item to be cleaned is positioned within a cleaning chamber mounted on a turntable platform and cleaning sprays directed at the part. The part is conveniently loaded by movement of the turntable platform on a trolley towards the front of the machine through an access door to the cleaning chamber to be positioned in a loading station. An externally mounted operating mechanism for the turntable trolley is disclosed consisting of a cable cylinder mounted along side the cleaning machine cabinet operating a system of cables secured to the front and rear of the trolley and causing the trolley to be moved between its loading and cleaning positions. A counterweight arrangement is also provided for the frontal access door to the cleaning chamber consisting of a pair of counterweights suspended on chains engaging sprockets fixed to a common axle to produce a driving connection between each counterweight, such that each counterweight acts jointly on the access door with the counterweights being received within a pair of upright box columns guiding the door in its up and down movement.

9 Claims, 4 Drawing Figures

CLEANING MACHINE WITH EXTERNALLY MOUNTED TURNTABLE TROLLEY OPERATOR

BACKGROUND DISCUSSION

Reference is made to U.S. Pat. Nos. 3,422,826; 3,452,763; 3,656,491 and 4,133,340, all granted to the present inventor, which describe cleaning machines of the type specially adapted to degreasing of automotive parts such as transmission housings, engine blocks, etc. Each of these machines consists of a cabinet structure including a lower reservoir section and an upper cleaning chamber section within which the items to be washed are disposed during the wash cycle. The bottom reservoir section contains a volume of cleaning solution such as a caustic soda solution which is heated and caused to be pumped into a system of manifold pipes through spray nozzles which are adapted to direct a powerful cleaning spray at the items to be washed. The items are mounted on a turntable which is rotated as by a turbine jet impinging on paddle wheels, so as to be impinged by the turbine jet spray and cause rotation of the turntable and the part to assure thorough and complete coverage of the part within the washing chamber.

In U.S. Pat. No. 3,656,491, this turntable is mounted on a trolley which is adapted for in and out movement into and out of the washing chamber, passing through a frontal access door to a loading station such that the parts may be loaded onto the turntable with the turntable in a position outside the washing chamber. The loading station is free from overhead machine structure, such that the implacement of such relatively heavy articles as transmission housings and engine blocks is facilitated, since hoisting apparatus may be employed to assist in loading the part. Subsequent movement of the trolley and the turntable and part through the frontal access door disposes the same within the washing chamber.

While this is relatively convenient, the movement of the trolley has heretofore been carried out manually which adds to the physical effort required on the part of the operator in performing the washing and degreasing of these parts.

While a power-operated cylinder or other means could be directly added to the trolley, this is a relatively difficult design problem since the atmosphere within the washing chamber and reservoir section is relatively deleterious due to the presence of the volume of heated washing solution, and overspray from the cleaning jets and is usually at a very high humidity in washing machines employing a water solution.

While complex linkages and separate housing for the operating structure could be devised, such operating or power mechanism should very desirably be simple in configuration such as to be modest in cost when added to the basic cleaning machine, while at the same time being highly reliable in its operation.

The front access door itself is moved vertically upwardly from its closed position to open the washing chamber for access thereto, which movement has also been carried out manually. It would be highly desirable to counterweight the same in order to reduce the effort involved on the part of the operator. While counterweighting is an advantageous approach to reduce the operating effort, such counterweighting should insure that in the event of losing one of the counterweights, that the door is not suddenly dropped or that the counterweights themselves do not fall free of the machine creating possible injury or damage to the machine.

Accordingly, it is an object of the present invention to provide a cleaning machine of the type described in which the turntable trolley is adapted to be power actuated in its movement in and out of the washing chamber, which power operating mechanism is extremely simple and is externally mounted from the washing chamber and the reservoir cabinet such as to not be subject to the corrosive conditions within the cleaning machine. At the same time, the mechanism is extremely simple in configuration such as to be able to be provided at relatively low cost and insuring reliable operation.

It is another object of the present invention to provide a counterweighting of the frontal access door in which the sudden dropping of the door due to failure of the counterweight suspension is largely avoided.

SUMMARY OF THE INVENTION

These and other objects of the present invention, which will become apparent upon a reading of the following specification and claims, are achieved by a cleaning machine of the type described in which a cable cylinder is mounted externally of the cleaning machine cabinetry, extending in a direction parallel to the line of motion of the trolley and with a cable system extending through either end of the cable cylinder through a pulley system and secured to the front and rear of the trolley, respectively. Upon cycling of the cable cylinder, a directly corresponding movement of the turntable trolley within the interior of the machine is induced, thus enabling a power operation of the trolley movement from the in-washing position, which the trolley is disposed within the washing chamber to an out-loading position, in which the trolley is disposed out to the front of the machine enabling overhead loading of parts onto the turntable carried by the turntable trolley.

The counterweight system includes a pair of counterweights secured to respective sprocket chains passing about the sprocket wheels affixed to either end of a common axle shaft suspended over the access door with the respective sprocket chains being drivingly secured to either side of the lower portion of the pins affixed to the lower edge of the access door. Each of the counterweights is slidably received within upstanding box columns providing a guiding of the sliding upward movement of the frontal access door, and which serve to contain the counterweights during their movement in correspondence with the opening and closing movement of the frontal access door. The driving connection between the sprockets afforded by the common axle insures that the counterweighting influence of either weight is applied jointly to both sides of the frontal access door, such that if one of the counterweights falls free due to failure of the chain affixed to the counterweight, the counterweighting influence of the remaining weight is still exerted on the door preventing a too rapid closing motion of the access door.

The common shaft also guides the movement of the door due to the resultant prevention of skewing or yawing of the door in its guide tracks.

The confinement of the counterweights within the box column on either side of the cleaning machine insures that if either or both of the counterweights were to fall free that these would be confined to the machine within the machine cabinetry, thus preventing injury to the machine operator.

DETAILED DESCRIPTION

In the following detailed description, certain specific terminology will be utilized for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Figure 1:
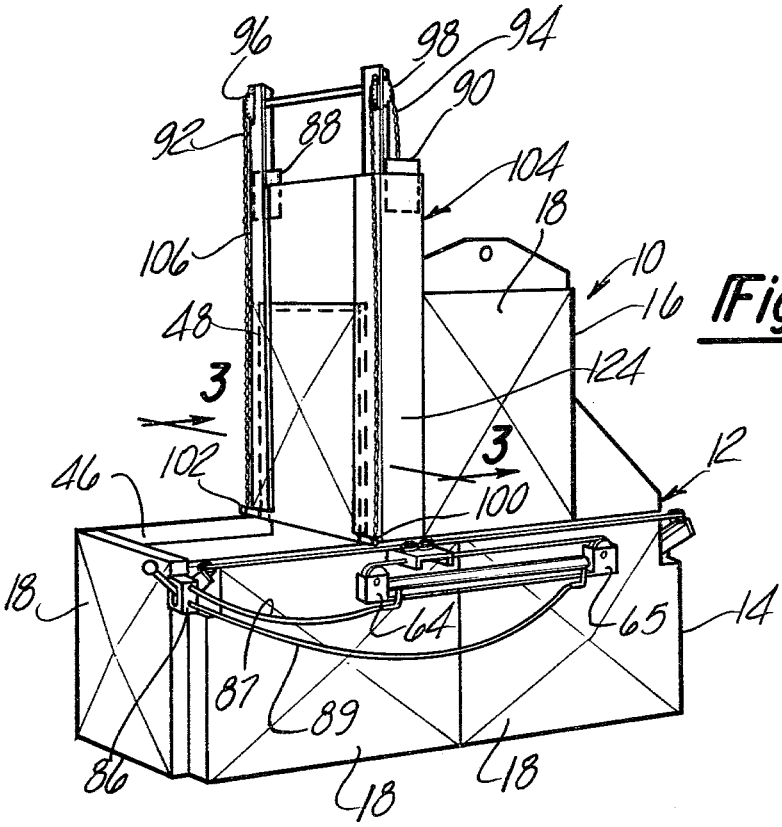
FIG. 1 is a perspective view of the cleaning machine incorporating the features according to the present invention.

The cleaning machine 10 depicted in FIG. 1 is of the general type disclosed in the aforementioned U.S. Patents comprising a cabinet structure 12 consisting of a lower reservoir section 14 and an upper cleaning chamber section 16. The upper cleaning chamber section 16 is mounted atop the lower reservoir section 14, but occupies only a portion of the length thereof to provide a loading station to the front of the machine.

The cabinet structure 12 is of an insulated panelframe construction which encloses panel sections 18, which serve to insulate the cabinet in order to conserve heat since the cleaning solution is heated to relatively elevated temperatures in order to improve the cleaning action in a manner described in the aforementioned patents.

Figure 3:
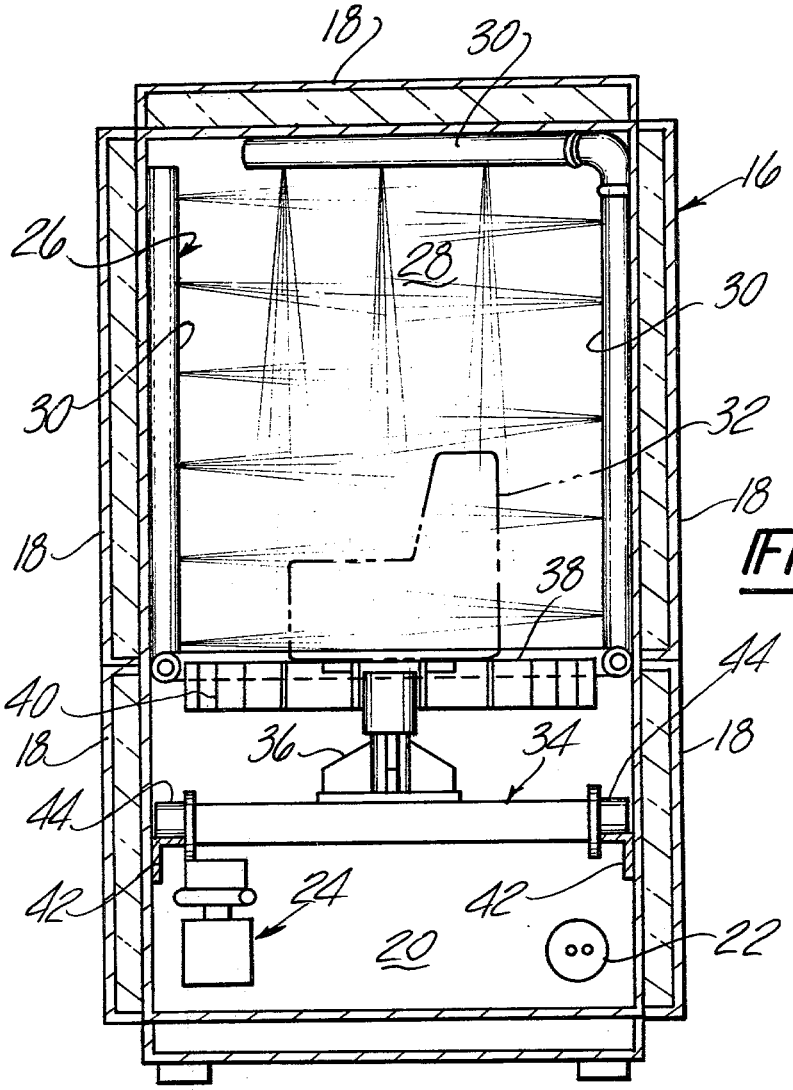
FIG. 3 is a vertical sectional view through the cleaning machine depicted in FIG. 1 showing the mounting of the turntable trolley and the basic layout of the washing chamber and cleaning solution reservoir sections of the cleaning machine cabinetry.
Figure 4:
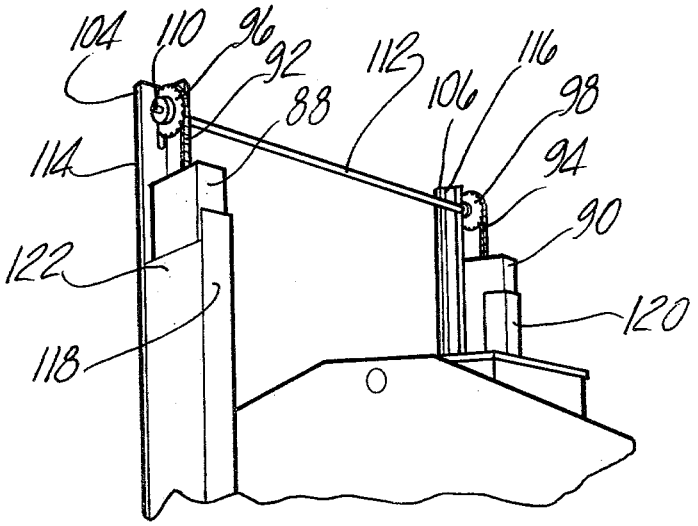
FIG. 4 is a partial perspective enlarged view of the cleaning machine shown in FIG. 1 depicting the details of the counterweight mounting arrangement.

The lower reservoir section 14 defines a cleaning solution reservoir 20 (FIG. 3) within which is disposed a volume of cleaning solution such as a caustic soda-water solution. Electric or gas heating is provided such as the resistance strip element indicated at 22 (FIG. 3) which serves to heat the solution disposed therein.

A pump and filter assembly 24 is also provided operated by an externally mounted electric motor (not shown) and which causes a flow of the cleaning fluid under pressure into a manifold system generally indicated at 26 arrayed about the interior of the upper cleaning chamber section 16 which defines a cleaning chamber 28.

The manifold system 26 includes a plurality of spray pipes 30 extending about the cleaning chamber 28 and having orifices or slits formed in the pipe faces disposed towards the central area of the cleaning chamber 28 and which are adapted to direct powerful cleaning sprays at the interior of the cleaning chamber 28 and towards a workpiece indicated in phantom at 32 disposed therein during the cleaning cycle of the machine.

The lower reservoir section 14 is of a greater length than the upper cleaning chamber section 16 which is mounted atop thereof and occupying only a portion of length. This enables a turntable trolley 34 to be mounted for linear movement within the cleaning solution reservoir 20 of the bottom section for in and out movement into and out of the interior cleaning chamber 28 to a loading station. The turntable trolley 34 provides a support for a turntable pedestal 36 in turn supporting the turntable 38 itself.

Turntable 38 provides a rotary workholder for the workpiece 32 or other items to be washed such as the transmission housing or other similar item and includes paddle wheel sections 40 which are adapted to be impinged by a turbine jet spray to cause rotation of the turntable 38 during the washing operation of the cleaning machine 10. Inasmuch as this arrangement is well known in the art and described in the aforementioned U.S. Patents, the related complete details of the machine are not here included.

The turntable trolley 34 is mounted for such linear movement on a pair of parallel rails 42 provided on either side of the cleaning solution reservoir 20 interior walls and extending substantially along the length thereof such as to provide a support for aligned pairs of roller bushings 44 mounted at each corner of the turntable trolley 34.

Thus, the turntable 38 may be positioned within the interior of the cleaning chamber 28 or over an opening 46 formed in the lower reservoir section 14 passing through a frontal access opening normally covered by a frontal access door 48.

A cover (not shown) is normally provided extending over the opening 46 except when parts or items are being loaded onto the turntable 38.

According to the concept of the present invention, the turntable trolley 34 is caused to undergo its movement from its in-position, disposed within the cleaning chamber 28, and its out-position, disposed within frontal access door 48, by a power actuation arrangement which is mounted primarily externally of the cabinet structure 12.

This arrangement includes a power cylinder 50 mounted along side and exteriorly of the lower reservoir section 14 extending parallel to the parallel rails 42 adjacent the upper edge of the lower reservoir section 14. Such cable cylinders are commercially available and include a cylinder body 52 having an air or hydraulically actuated piston disposed therein which is drivingly connected to an operating element comprised of flexible cables 54 and 56 joined to a bracket 58 to form a cable loop. The flexible cables 54 and 56 pass around respective pulleys 60 and 62 pivotally mounted on bracket structures 64 and 65 at either end of the cylinder body 52.

Upon pressurization of the cylinder on either side of the piston, the flexible cables 54 and 56 are caused to move one direction or the other depending on which side of the piston is pressurized, causing reciprocation of the bracket 58. This arrangements allows pulling movement on either of a pair of operating cables 66 and 68, each affixed to bracket 58 such as to alternately be pulled by operation of the power cylinder 50.

The front operating cable 68 passes about or around a pair of pulleys 70 and 72, each pivotally mounted on a mounting bracket 74 inclined and extending into the interior of the cleaning solution reservoir 20 through the frontal access door 48. The rear operating cable 66 similarly passes about and around a pair of idler pulleys 76 and 78 pivotally mounted on a bracket inclined into the cleaning solution reservoir 20 at the rear portion of the lower reservoir section 14.

The free end of each of the operating cables 66 and 68 are affixed to the turntable trolley 34 at the rear and front portions thereof extending through loops 82 and 84, respectively.

Figure 2:
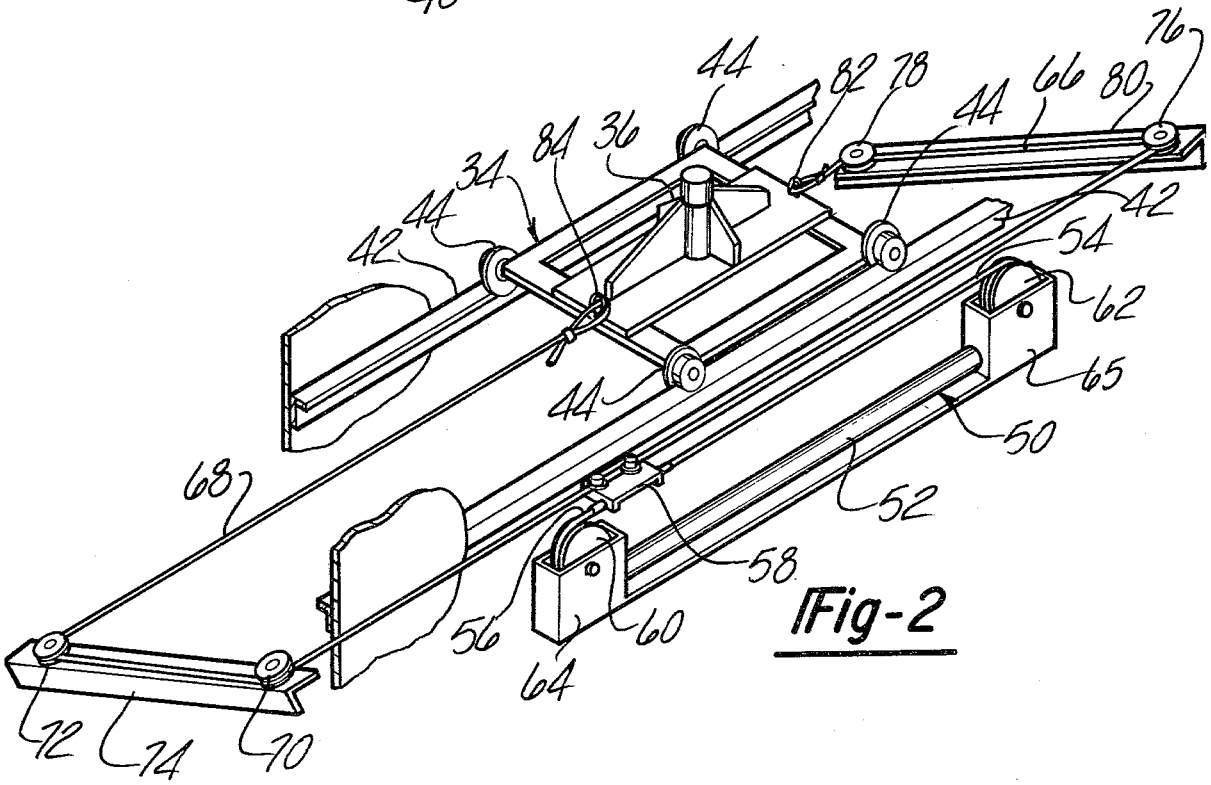
FIG. 2 is a perspective view of the trolley operating mechanism incorporated in the cleaning machine of FIG. 1.

Thus, a corresponding constrained movement of the turntable trolley 34 is induced by operation of the power cylinder 50. The retraction of the flexible cable 56 as shown in FIG. 2 causes extension of the flexible cable 54, in turn producing withdrawal of the rear operating cable 66 and forward positioning of the turntable trolley 34 within the cleaning chamber 28.

In reversing of the cylinder cycle, the turntable trolley 34 is caused to move away along parallel rails 42 to the outboard loading position by retraction of the flexible cable 54 with pulling motion thus exerted on the front operating cable 68.

Thus, the main power component, i.e., the power cylinder 50, is mounted exteriorly of the cabinet structure 12 to thereby not be exposed to the corroding conditions within the cleaning solution reservoir 20 and in the cleaning chamber 28.

At the same time, the arrangement is extremely simple in configuration such as to be incorporated at relatively low cost and should be highly reliable in operation.

The entire operation of the power cylinder 50 is preferably under the control of the two-way, hand-operated valve 86 positioned in the front of the cleaning machine 10 and having pressure lines controlling pressurization of the compressed air lines 87 and 89 in communication with the pressure source line (not shown) such that the operator may conveniently cause the in and out loading and cleaning position of the turntable trolley 34 and greatly reduce the exertion required of the operator in the loading and unloading of the items.

It should be noted that preferably a cover would be placed over the external components of the power operating turntable trolley arrangement, which is shown removed in order to reveal the details thereof.

The frontal access door 48 is counterweighted by means of a pair of counterweights 88 and 90 which are affixed to a length of sprocket chain 92 and 94 which pass over a pair of sprocket wheels 96 and 98 and thence downwardly to a lower bottom edge of the frontal access door 48 being affixed to end pins 100 and 102. The frontal access door 48 is guided in its vertical up and down movement undergone during opening and closing with a pair of upstanding box columns 104 and 106 to provide an edge guiding of the lateral edges of the frontal access door 48 and which also provide a mounting structure for the sprocket wheels 96 and 98.

This mounting is by virtue of a common axle shaft 110 passing through a cross tube 112 affixed to either upstanding box column 104 or 106. The axle shaft 110 insures a driving interconnection with the respective sprocket wheels 96 and 98 such that if one of the counterweights 88 or 90 becomes disconnected from its sprocket chain, the force exerted on the door will continue to be exerted by the remaining counterweight 88 or 90 through both of the sprocket chains 92 and 94, insuring that a sudden rapid dropping of the front access door 48 will not occur.

Each of the counterweights 88 and 90 are slidably received within the interior of the respective upstanding box columns 104 and 106 which are comprised of angle assemblies 114 and 116 and rear angle assemblies 118 and 120 and side plates 122 and 124, such that the counterweights 88 and 90 are substantially confined during their sliding up and down movement and guided by the interior of the upstanding box columns 104 and 106. This insures that if a counterweight should come loose, the same will be confined and not allowed to drop freely from the machine, thus avoiding damage to the machine or injury to the operator or other persons who may be standing nearby. In addition, movement of the counterweights is also shielded such as to preclude the moving counterweights from coming into contact with objects or individuals in the vicinity.

The common axle shaft also precludes tilting or yawing of the door, such that the door moves "true" to the edge guides, preventing jamming and dragging of the door.

Accordingly, it can be appreciated that the cleaning machine according to this design enhances these aspects of the cleaning machine, i.e., the automatic or powered movement of the turntable trolley between its respective load and unload positions, substantially alleviating the physical exertion required to operate the machine, particularly since some workpieces such as engine blocks and transmission housing are quite heavy, as is the turntable trolley itself.

The mounting of the front access door is likewise improved over previous versions by virtue of the recessed and drivingly interconnected counterweights, to yield a counterweighted door therefor which minimizes difficulties associated with the dropping or failure of the counterweight connector and also associated with the movement of the counterweight during the door opening and closing.

Accordingly, it is seen that the above-cited objects of the present invention have been achieved by the described cleaning machine.

The embodiments of the invention in which an exclusive property or privilege is claimed are defined as follows:

1. A cleaning machine comprising:

a cabinet, including a lower reservoir section and a cleaning chamber upper section mounted over said reservoir section, said cleaning chamber cabinet occupying a portion of the length of said lower section;

means for directing a spray of cleaning solution contained in said reservoir lower section into the interior of said cleaning chamber defined by the interior of said upper section;

a frontal access door formed in said cleaning chamber cabinet section adjacent said portion of said reservoir lower section not covered or occupied by said cleaning chamber cabinet section;

means movably mounting said frontal access door to provide access to the interior of said cleaning chamber cabinet section;

a work holder adapted to support workpieces during cleaning operations in said cleaning chamber and means supporting said work holder on said reservoir lower section, said means including a trolley and means supporting said trolley for linear movement within said reservoir lower section between advanced positions disposed beneath said cleaning chamber upper section and a retracted loading position without said cleaning chamber upper section;

a power operating mechanism for positioning said trolley between said advanced and retracted positions, said arrangement comprising a cylinder mounted exteriorly of said cleaning machine cabinet with its axis parallel to said direction of movement of said trolley within said cabinet reservoir section, said power cylinder having an actuating element reciprocated by actuation of said power cylinder means, said power operating arrangement further including means drivingly connecting said trolley with said actuating element of said power cylinder means producing corresponding movement thereof, whereby said trolley may be positioned by actuation of said power cylinder means, and wherein said actuating element comprises a flexible cable loop wherein said power cylinder means further includes a a pair of pulleys receiving a section of said loop and each of said sections passing along side of said cylinder.

2. The cleaning machine according to claim 1 wherein said means drivingly connecting said actuating element and said trolley comprises a bracket means affixed to said cable loop and further includes front and rear cable sections affixed to said bracket to be moved therewith, each of said cable operating sections further including pulley means supporting said front and rear operating cable sections, respectively, to be passed directly toward the front and rear portions of said trolley and means affixing each of said front and rear sections to said trolley, whereby actuation of said power cylinder means produces reciprocation of said bracket in corresponding alternate pulling of said front and rear operating cable sections to produce said movement of said trolley.

3. The cleaning machine according to claim 2 wherein said pulley means comprises a pair of pulleys located at either end of said reservoir lower section, each of said pairs of pulleys being mounted to a member inclined downwardly into the interior of said reservoir cabinet from the top thereof, and wherein said power cylinder assembly is located adjacent the top edge of said cabinet reservoir means, whereby said front and rear operating cable sections are passed into contact with the uppermost of said pair of pulleys and thence downwardly into the interior of said cabinet exterior reservoir and thence forwardly and rearwardly to said trolley.

4. The cleaning machine according to claim 3 wherein said power cylinder means includes a manually actuated valve means located in the front portion of said reservoir lower section.

5. The cleaning machine according to claim 1 wherein said work holder comprises a rotatable turntable and further including a turntable pivot mounted to said trolley and wherein said trolley is rotatably mounted on said turntable pivot.

6. The cleaning machine according to claim 1 wherein said front access door movement is assisted by counterweight means, said counterweight means comprising a pair of counterweights, flexible connecting elements and rotatable sprocket wheels mounted above said cleaning chamber upper section and receiving said flexible element by being passed therearound and downwardly, said flexible elements each drivingly connected to the lower portion of said frontal access door, whereby said up and down movement of said frontal access door is assisted by said counterweights acting through said flexible elements.

7. The cleaning machine according to claim 6 wherein said counterweight means further includes an axle shaft extending between each of said sprocket wheels, and having each of said sprocket wheels affixed thereto, whereby a driving interconnection of each of said respective counterweight means is created.

8. The cleaning machine according to claim 7 wherein said flexible elements comprise sprocket chains engaging said respective sprocket wheels, whereby said counterweighting force is applied to both of said sprocket wheels.

9. The cleaning machine according to claim 8 wherein said means for supporting said sprocket wheels comprises a pair of upstanding box columns adjacent said frontal access door, each of said box columns slidably receiving a respective counterweight, whereby said counterweight movement is guided and shielded by said respective upstanding box columns.

* * * * *